United States Patent [19]

Nakajima et al.

[11] Patent Number: 4,576,132

[45] Date of Patent: Mar. 18, 1986

[54] ENGINE STARTING AIR FUEL RATIO CONTROL SYSTEM

[75] Inventors: Masataka Nakajima, Tokyo; Yasushi Mase, Hachioji; Yoshiharu Tamura, Yokohama, all of Japan

[73] Assignee: Nissan Motor Company, Limited, Yokohama, Japan

[21] Appl. No.: 666,038

[22] Filed: Oct. 29, 1984

[51] Int. Cl.[4] ..... F02D 41/06

[52] U.S. Cl. ..... 123/438; 123/179 G

[58] Field of Search ..... 123/179 G, 438, 491, 123/588

[56] References Cited

U.S. PATENT DOCUMENTS 4,349,877 9/1982 Oyama et al. ..... 123/438

4,462,375 7/1984 Isobe et al. ..... 123/491

4,480,618 11/1984 Kamifuji et al. ..... 123/179 G 4,492,206 1/1985 Hasegawa et al. ..... 123/491

*Primary Examiner*—Andrew M. Dolinar

*Attorney, Agent, or Firm*—Schwartz, Jeffery, Schwaab, Mack, Blumenthal & Evans

[57] ABSTRACT

An increase in the amount of fuel when an engine is started or being idled is controlled on the basis of a detected intake air temperature or outside air temperature in addition to detected engine speed, intake air pressure and engine coolant temperature. Therefore, it is possible to obtain a mixture with an appropriate air-to-fuel ratio corresponding to intake air temperature in starting the engine, thus improving engine starting characteristics at low outside air temperature.

7 Claims, 5 Drawing Figures

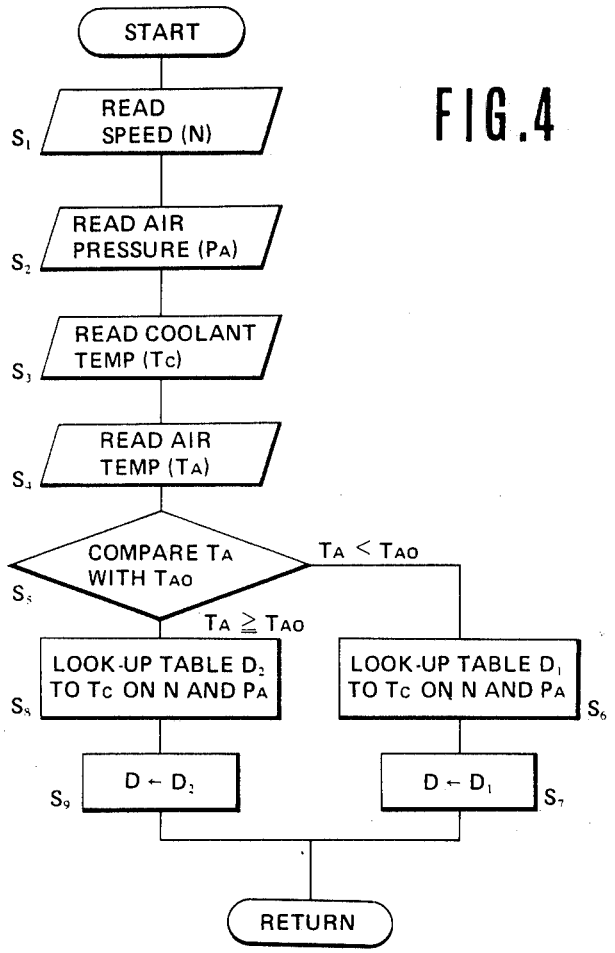
FIG.4
FIG.5
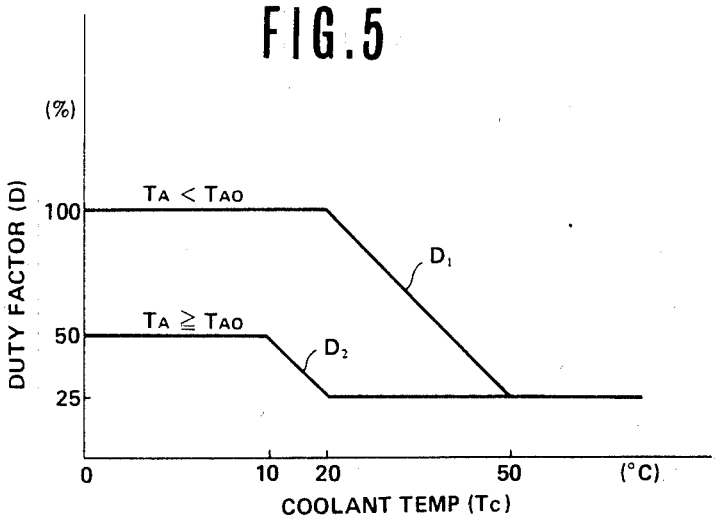

ENGINE STARTING AIR FUEL RATIO CONTROL SYSTEM

BACKGROUND OF THE INVENTION

1. Field of the Invention

The present invention relates generally to an engine-starting air-to-fuel ratio control system and more specifically to an electronic control system incorporated with a carburetor including an actuator for increasing the amount of fuel supplied to an engine when th engine is started or being idled.

2. Description of the Prior Art

Recently, electrically or electronically controlled carburetors have been developed in order to improve engine starting characteristics when an engine is started or being idled, in particular, at low temperatures. In these carburetors, a starter nozzle is provided on the downstream side of a throttle valve to supply a rich mixture into an engine without installing a conventional choke valve. An example of these engine-starting air-to-fuel ratio control apparatus is disclosed in Japan Unexamined Patent Application No. 58-135347.

In this apparatus, a richer mixture supplying solenoid is installed in a passage communicating with the starter nozzle in order to increase the amount of fuel in starting an engine. In more detail, when an engine is started or being idled, the richer mixture supplying solenoid is activated to additionally supply fuel through the starter nozzle or to supply a rich mixture. Further, the increase in the amount of fuel is determined on the basis of detected engine speed, intake air pressure and engine coolant temperature.

In the prior-art engine-starting air-to-fuel ratio control apparatus as described above, however, because the amount of increase in fuel is controlled by only three factors (engine speed, intake air pressure and engine coolant temperature), the engine starting characteristics are subjected to change in outside air (intake air) temperature, thus resulting in a problem in that engine starting characteristics are not satisfactory. For instance, even if coolant temperature is at an appropriate value, when outside air temperature is low, fuel will not be evaporated stably and therefore air-to-fuel ratio increases (mixture becomes lean) as compared with when outside air temperature is high. As a result, the engine starting characteristics are deteriorated.

The arrangement of the prior-art engine-starting air-to-fuel ratio control apparatus will be described in greater detail hereinafter with reference to the attached drawing under DETAILED DESCRIPTION OF THE PREFERRED EMBODIMENTS.

SUMMARY OF THE INVENTION

With these problems in mind, therefore, it is the primary object of the present invention to provide an engine-starting air-to-fuel ratio control system which can improve engine starting characteristics at lower outside air temperatures by controlling the increase in the amount of fuel at engine starting on the basis of detected intake air temperature or outside air temperature in addition to detected engine speed, intake air pressure and engine coolant temperature.

To achieve the above-mentioned object, the engine-starting air-to-fuel ratio control system according to the present invention comprises (a) an engine speed sensor for outputting an engine speed signal; (b) an intake air pressure sensor for outputting an intake air pressure signal; (c) an engine coolant temperature sensor for outputting an engine coolant temperature signal; (d) an intake air temperature sensor for outputting an intake air temperature signal; (e) fuel control means for determining the increase in the amount of fuel in response to the detected engine speed signal, the detected intake air pressure signal, the detected signal coolant temperature signal and the detected intake air temperature signal and for outputting a control signal representative of the increase in the amount of fuel; and (f) an actuator associated with a carburetor and activated in response to the control signal outputted from said control means for increasing the amount of fuel supplied to the engine through the carburetor.

To achieve the above-mentioned object, the method of controlling air-to-fuel ratio in starting an engine in cooperation with a carburetor according to the present invention comprises the following steps of (a) detecting engine speed N; (b) detecting intake air pressure $P_A$; (c) detecting engine coolant temperature $T_C$; (d) detecting intake air temperature $T_A$; (e) comparing the detected intake air temperature $T_A$ with a reference value $T_{AO}$; (f) if the detected intake air temperature $T_A$ is lower than the reference value $T_{AO}$, selecting a lower air temperature table $D_1$ with the detected engine speed N and intake air pressure $P_A$ as parameters; (g) selecting a duty factor corresponding to the detected coolant temperature $T_C$ from the lower air temperature table $D_1$; (h) if the detected intake air temperature $T_A$ is equal to or higher than the reference value $T_{AO}$, selecting a higher air temperature table $D_2$ with the detected engine speed N and intake air pressure $P_A$ as parameters; (i) selecting a duty factor corresponding to the detected coolant temperature $T_C$ from the higher air temperature table $D_2$; (j) generating a control signal having the selected duty factor; and (k) activating an actuator associated with the carburetor in response to a control signal to increase the amount of fuel to be supplied to the engine through the carburetor.

BRIEF DESCRIPTION OF THE DRAWINGS

The features and advantages of the engine-starting air-to-fuel ratio control system according to the present invention over the prior-art control apparatus will be more clearly appreciated from the following description of the preferred embodiments of the invention taken in conjunction with the accompanying drawings in which like reference numerals designate the same or similar elements or sections throughout the figures thereof and in which:

FIG. 4 is a flowchart showing the steps of controlling air-to-fuel ratio in starting an engine according to the present invention; and FIG. 5 is a graphical representation showing an example of relationship between duty factor D of control pulse signal and engine coolant temperature $T_C$ with intake air temperature $T_A$ as parameter.

DETAILED DESCRIPTION OF THE PREFERRED EMBODIMENTS

To facilitate understanding of the present invention, a brief reference is made to the prior-art engine-starting air-to-fuel ratio control apparatus disclosed in Japan Unexamined Patent Application No. 58-135347, entitled An Engine Starting Apparatus for a Carburetor, by way of example.

Figure 1:
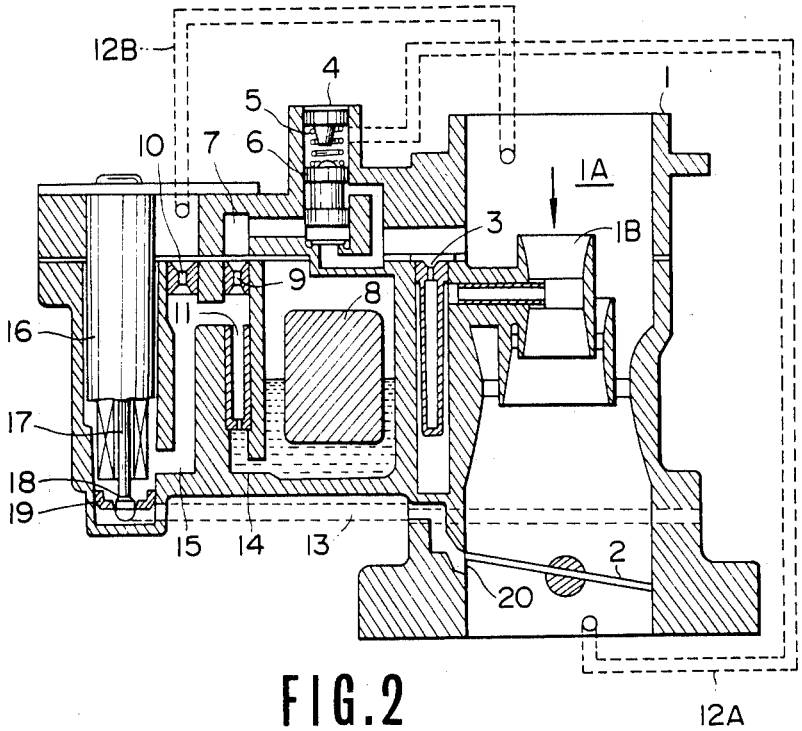
FIG.1 (PRIOR ART)
FIG. 1 is a cross-sectional view showing an example of a carburetor used with a prior-art engine-starting air-to-fuel ratio control apparatus.

FIG. 1 is a vertical cross-sectional view of the carburetor used with the prior-art engine starting apparatus. Within an intake passage 1A of a carburetor body 1, a throttle valve 2 is arranged. A main air bleeder 3 is disposed on the upstream side of the venturi portion 1B. The main air bleeder 3 communicates with an auxiliary air bleeder 4.

When vacuum increases on the downstream side of the throttle valve 2, vacuum is introduced into a chamber, within which an auxiliary air bleeder spring 5 is housed, through a vacuum passage 12A shown by dashed lines in FIG. 1 in order to decrease the pressure of the bleeder spring chamber, so that the spring 5 is compressed to open an auxiliary valve 6. Therefore, the intake passage 1A communicates with an auxiliary air passage 7. On the other hand, the upstream side of an air bleeder 10 communicates with an intake passage 1A disposed on the downstream side of an air cleaner (not shown) through a passage 12B shown by dashed lines in FIG. 1 to introduce fresh air. Therefore, air is supplied to the intake passage 1A through both an air bleeder 9 and an air bleeder 10. Since the diameter of the air bleeder 9 is so designed as to be greater than that of the air bleeder 10, pressure within a rich fuel supplying passage 15 drops below atmospheric pressure. Accordingly, fuel absorbed through a rich fuel jet 14 goes up along a fuel passage 11 and then drops into the rich fuel supplying passage 15. An engine starting nozzle 20 is disposed on the downstream side of the throttle valve 2 so as to communicate with a rich fuel supplying valve 18 opened by a rich fuel supplying solenoid 16 through a mixture passage 13 also shown by dashed lines in FIG. 1. A plunger 17 is disposed so as to pass through the central hole of the solenoid 16. The valve 18 is fixed to the lower end of the plunger 17 so as to be in contact with a valve seat 19 communicating with the mixture passage 13.

In the apparatus as described above, it is possible to control the air-to-fuel ratio of the mixture supplied from the engine starting nozzle 20 by actuating the rich fuel supplying solenoid 16. To actuate the solenoid 16, an actuating signal with a constant frequency is applied to the solenoid 16 by controlling the duty factor thereof. Duty factor is a ratio (tw/T) of pulse width (tw) to pulse period (T). A rich mixture is supplied to the intake passage 1A through the engine starting nozzle 20 when an engine is started or being idled; a lean mixture is supplied to the intake passage 1A through the same nozzle 20 after the engine has been started or after the engine has been warmed up.

In the carburetor as described above, in particular, the diameter of the air bleeder 9 is so designed as to be greater than that of the air bleeder 10, and additionally the diameter of the fuel passage 11 is so designed as to be smaller than that of the air bleeder 9, in order to reduce time delay in supplying fuel, without being subjected to the influence of air dynamic pressure fluctuation. In more detail, the inner diameter of the fuel passage 11 is as small as about 1.5 mm so as to function as a capillary tube for facilitating of pushing fuel level up within the passage 11.

In the prior-art apparatus as described above, the duty factor of the pulse signal applied to the rich fuel supplying solenoid 16 is adjusted by a control unit (not shown) on the basis of engine speed, intake air pressure and engine coolant temperature. Therefore, the engine starting characteristics are inevitably subject to change in outside air (intake air) temperature. This results in a problem in that when outside air temperature is low, fuel will not be evaporated stably and therefore mixture becomes lean even if coolant temperature is sufficiently high, thus resulting in deterioration of engine starting characteristics.

Figure 2:
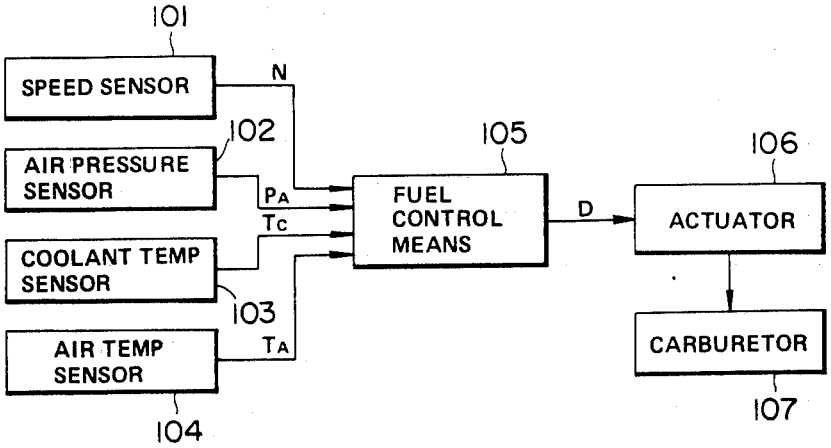
FIG. 2 is a basic schematic block diagram showing the engine-starting air-to-fuel ratio control system according to the present invention.

In view of the above description, reference is now made to the basic embodiment of the engine-starting air-to-fuel ratio control system according to the present invention with reference to FIG. 2.

The system comprises an engine speed sensor 101, an intake air pressure sensor 102, an engine coolant temperature sensor 103, an intake air temperature sensor 104, a fuel control means 105, an actuator 106 and a carburetor 107. The engine speed sensor 101 detects the number N of engine revolutions per minute. The intake air pressure sensor 102 detects the pressure $P_A$ of intake air introduced into an engine. The engine coolant temperature sensor 103 detects the temperature $T_C$ of engine coolant. The intake air temperature sensor 104 detects the temperature $T_A$ of intake air introduced into the engine. The fuel control means 105 determines fuel increase on the basis of the detected engine speed N, intake air pressure $P_A$, coolant temperature $T_C$ and intake air temperature $T_A$ and outputs a control signal D. The actuator 106 is activated in response to the control signal D from the fuel control means 105. The carburetor 107 supplies an appropriate amount of fuel to the engine according to the amount of intake air and increases the amount of fuel to be supplied to the engine when an engine is started by activating actuator 106. The system according to the present invention can increase fuel to be supplied to the engine on the basis of, in particular, a detected intake air temperature $T_A$ or an outside air temperature in addition to a detected engine speed N, intake air pressure $P_A$ and engine coolant temperature $T_C$, in order to improvement in engine starting characteristics.

Figure 3:
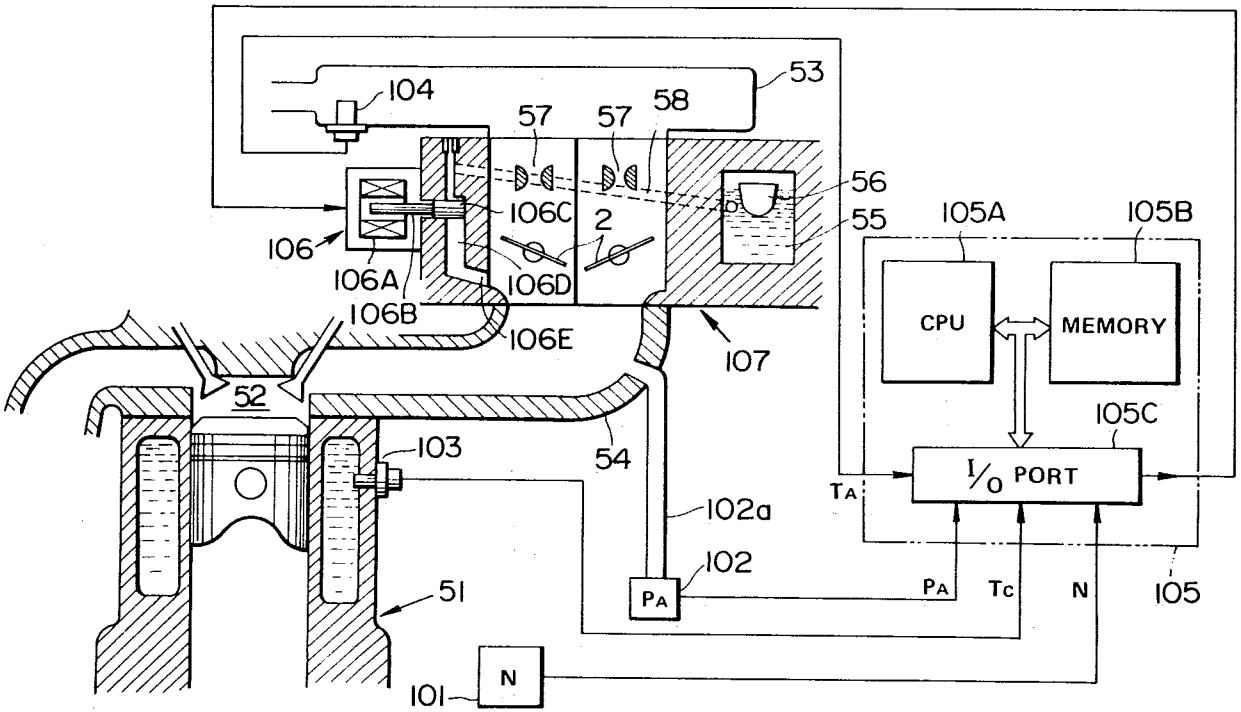
FIG. 3 is a diagrammatical view including a block diagram showing the engine-starting air-to-fuel ratio control system according to the present invention.

FIG. 3 shows an embodiment of the engine-starting air-to-fuel ratio control system according to the present invention. An engine is provided with a combustion chamber 52, into which mixture is supplied through an intake pipe 54. The mixture is obtained by mixing intake air cleaned through an air cleaner 53 with fuel supplied from a float chamber 55 through a fuel passage 58 at two venturi portions 57. The two venturi portions 57 are arranged in a primary passage and a secondary passage of the carburetor 107, respectively, on the upstream side of two throttle valves. Further, the reference numeral 56 denotes a float.

The engine speed sensor 101 for detecting the number N of engine revolutions per unit time is a crank angle sensor arranged in conjunction with an engine crank shaft (not shown).

The intake air pressure sensor 102 for detecting intake air pressure $P_A$ is disposed at an appropriate position to which pressure within the intake passage 54 on the downstream side of the throttle valve 2 is introduced via a pressure pipe 102*a*.

The engine coolant temperature sensor 103 for detecting engine coolant temperature $T_C$ is disposed at an appropriate position of an engine cylinder block or a radiator (not shown).

The intake air temperature sensor 104 for detecting intake air temperature $T_A$ is disposed at an appropriate position within the air cleaner 53. However, it is possible to dispose this intake air temperature sensor 104 within the intake pipe 54 for detection of mixture temperature on the downstream side of the throttle valve 2. Furthermore, it is also possible to dispose this intake air temperature sensor 104 on the outside of the air cleaner 53 for detection of outside air temperature.

The carburetor 107 is provided with a richer fuel supplying actuator 106 made up of a solenoid 106A, a plunger 106B slidably passed through the central hole of the solenoid 106B and a valve 106C fixed to the plunger 106B. The valve 106C is so arranged as to control the cross-sectional area of a richer fuel supplying passage 106D formed in the wall of the carburetor 107 so as to communicate with the float chamber 55 through the fuel passage 58. An engine starting nozzle 106E is disposed at the end of the passage 106D to supply fuel into the intake passage. The above-mentioned richer fuel supplying actuator 106 serves as a choke valve which decreases air-to-fuel ratio (mixture is rich) when the engine is started or being idled.

The fuel control means 105 is a microcomputer made up of a central processing unit (CPU) 105A, memory units 105B such as read-only memory (ROM) and random access memory (RAM) and an input/output port 105C including analog-to-digital converters and digital-to-analog converters. The detection signals outputted from the four sensors 101 to 104 (speed N, air pressure $P_A$, coolant temperature $T_C$ and air temperature $T_A$) are all inputted to the control means 105 through the I/O port 105C, through which analog signals are converted into digital signals corresponding thereto. The CPU 105A reads external detection data signals, transfers or receives the read data signals to and from the RAM for executing data processing in accordance with control program stored in the ROM and outputs a control signal through the I/O port 105C. Further, in the memory unit 105B, necessary data are previously stored in the form of tables as described later in more detail.

The control signal applied from the control means 105 to the richer fuel supplying solenoid 106A of the actuator 106 is a pulse signal, the duty factor (Tw/T) of which is controlled by the fuel control means 105 on the basis of the detection data signals (N, $P_A$, $T_C$ and $T_A$).

Therefore, the greater the duty factor of the control signal, the wider the pulse width of the control signal and therefore the more the solenoid is energized to more widely open the richer fuel supplying passage 106D. In other words, when a control signal with a great duty factor is applied to the solenoid 106A, a richer mixture can be obtained. In contrast with this, when a control signal with a small duty factor is applied to the solenoid 106A, a lean mixture can be obtained.

The duty factors of the control signal are previously stored in the memory unit 105B in the form of tables under consideration of the parameters (N, $P_A$, $T_C$ and $T_A$). An example of this is shown in FIG. 5. In this graphical representation, when the engine coolant temperature $T_C$ is higher than 50° C., the duty factor D is fixedly determined at 25 percent. When the coolant temperature $T_C$ is lower than 50° C., the duty factor (D) is controlled separately as shown by two broken lines $D_1$ and $D_2$. In more detail, when the intake air temperature $T_A$ is lower than a predetermined reference temperature $T_{AO}$ (e.g. 15° C.), the duty factor $D_1$ is increased linearly from 25 to 100 percent while coolant temperature $T_C$ changes from 50° C. to 20° C. but kept at a constant value of 100 percent at coolant temperatures $T_C$ lower than 20° C. When the intake air temperature $T_A$ is equal to or higher than the reference temperature $T_{AO}$, the duty factor $D_2$ is increased from 25 to 50 percent while coolant temperature $T_C$ changes from 20° to 10° C. but kept at a constant value of 50 percent at coolant temperatures lower than 10° C. A number of such relationships between duty factors $D_1$ and $D_2$ and coolant temperatures $T_C$ as shown in FIG. 5 are stored in the memory unit 105B being classified by engine speed N and intake air pressure $P_A$, that is, with N and $P_A$ as parameters.

The operation of the engine-starting air-to-fuel ratio control system according to the present invention will be described hereinbelow.

The carburetor 107 supplies fuel into the engine 51 through the intake pipe 54 in such a way that the amount of fuel is appropriately controlled at two venturi portions 57 according to the amount of intake air. However, since no choke valve is provided, fuel to be increased in starting or idling the engine is supplied through the richer fuel supplying passage 106D by controlling the richer fuel supplying valve 106C. This valve 106C is controlled by the richer fuel supplying solenoid 106A, which is controlled by the duty factor of a control signal outputted from the fuel control means 105. Further, the control means 105 outputs the control signal to the solenoid 106A, the duty factor of which is determined in accordance with table look-up method. In the above-mentioned method, a duty factor D corresponding to a coolant temperature $T_C$ is retrieved from a data table selected with engine speed N, intake air pressure $P_A$ and intake air temperature $T_A$ as parameters.

The operation of the system according to the present invention will be described with reference to a control flowchart shown in FIG. 4, in which $S_1$ to $S_9$ denote each control step.

The control means 105 first reads an engine speed N from the engine speed sensor 101 in step $S_1$, an intake air pressure $P_A$ from the intake air pressure sensor 102 in step $S_2$, an engine coolant temperature $T_C$ from the coolant temperature sensor 103 in step $S_3$ and an intake air temperature $T_A$ from the intake air temperature sensor 104 in step $S_4$.

In step $S_5$, control compares the read intake air temperature $T_A$ with a reference temperature $T_{AO}$ (e.g. 15° C.). If $T_A$ is lower than $T_{AO}$, program control advances to step $S_6$. In step $S_6$, an appropriate duty factor corresponding to the read coolant temperature $T_C$ is retrieved from a lower air temperature table $D_1$ selected with the read engine speed N and intake air pressure $P_A$ as parameters. This retrieved duty factor is outputted from the control means 105 as a control signal in step $S_7$.

In contrast with this, in step $S_5$, if $T_A$ is higher than $T_{AO}$, program control advances to step $S_8$. In step $S_8$, an appropriate duty factor corresponding to the read coolant temperature $T_C$ is retrieved from a higher air temperature table $D_2$ selected under consideration of the read engine speed N and intake air pressure $P_A$. This retrieved duty factor is also outputted from the control means 105 as a control signal in step $S_9$.

As already explained with reference to FIG. 5, the duty factor of the control signal is controlled according to a table classified by intake air temperature $T_A$, with engine speed N, intake air pressure $P_A$ and coolant temperature $T_C$ as parameters, so that the fuel to be increased is mainly controlled according to intake air temperature $T_A$ (mixture or outside air temperature). Therefore, it is possible to appropriately increase fuel to be supplied to an engine through a carburetor in starting or idling an engine.

An described above, in the engine-starting air-to-fuel ratio control system according to the present invention, since the amount of increase in fuel when an engine is started or being idled is controlled on the basis of intake air temperature or outside air temperature in addition to engine speed, intake air pressure and engine coolant temperature, it is possible to obtain a mixture having an appropriate air-to-fuel ratio corresponding to intake air temperature at engine starting or idling, thus improving engine starting characteristics without being subjected to influence of outside air temperature.

It will be understood by those skilled in the art that the foregoing description is in terms of a preferred embodiment of the present invention wherein various changes and modifications may be made without departing from the spirit and scope of the invention, as set forth in the appended claims.

What is claimed is:

1. An engine-starting air-to-fuel ratio control system incorporated with a carburetor for supplying the amount of fuel into an engine according to the amount of intake air, which comprises:

(a) an engine speed sensor for outputting an engine speed signal;

(b) an intake air pressure sensor for outputting an intake air pressure signal;

(c) an engine coolant temperature sensor for outputting an engine coolant temperature signal;

(d) an intake air temperature sensor for outputting an intake air temperature signal;

(e) fuel control means for determining the amount by which fuel is to be increased in response to the detected engine speed signal, the detected intake air pressure signal, the detected engine coolant temperature signal and the detected intake air temperature signal, and for outputting a control signal representative of the amount of fuel to be increased, said control means comprising a microcomputer for outputting a control pulse signal, the duty factor thereof being controlled in accordance with table look-up method with the detected engine speed, intake air pressure, coolant temperature and intake air temperature as parameters, said duty factor of the control pulse signal being retrieved according to the detected coolant temperature $T_C$ from a lower air temperature table $D_1$ selected with the detected engine speed N and intake air pressure $P_A$ as parameters when the detected intake air temperature $T_A$ is lower than a reference intake air temperature $T_{AO}$, and from a higher air temperature table $D_2$ selected with the detected engine speed N and intake air pressure $P_A$ as parameters when the detected intake air temperature $T_A$ is equal to or higher than the reference intake air temperature $T_{AO}$; and (f) an actuator associated with the carburetor and activated in response to the control signal outputted from said control means for increasing the amount of fuel to be supplied to the engine through the carburetor.

2. The engine-starting air-to-fuel ratio control system as set forth in claim 1, wherein said actuator comprises:

(a) a richer fuel supplying valve disposed in a richer fuel supplying passage communicating with the downstream of a throttle valve of the carburetor; and (b) a richer fuel supplying solenoid energized in response to the control pulse signal of variable duty factor outputted from said microcomputer for controlling said valve to increase an cross-sectional area of the passage for supplying a richer mixture to the engine through the carburetor.

3. The engine-starting air-to-fuel ratio control system as set forth in claim 1, wherein in the lower air temperature table $D_1$, the duty factor is fixedly determined at a lower percent when engine coolant temperature $T_C$ is higher than a first predetermined value and at a higher percent when engine coolant temperature $T_C$ is lower than a second predetermined value lower than the first value, and increased linearly from the lower percent to the higher percent when engine coolant temperature $T_C$ changes from the first value to the second value and wherein in the higher air temperature table $D_2$, the duty factor is fixedly determined to the lower percent when engine coolant temperature $T_C$ is higher than the second value and to a middle percent when engine coolant temperature $T_C$ is lower than a third predetermined value lower than the second value and increased linearly from the lower percent to the middle percent when engine coolant temperature $T_C$ changes from the second value to the third value, these lower and higher air temperature tables $D_1$ and $D_2$ being selected according to the detected engine speed N and intake air pressure $P_A$.

4. The engine-starting air-to-fuel ratio control system as set forth in claim 1, wherein the reference intake air temperature $T_{AO}$ is approximately 15° C.

5. The engine-starting air-to-fuel ratio control system as set forth in claim 3, wherein the first predetermined value is 50° C., the second predetermined value is 20° C. and the third predetermined value is 10° C.

6. A method of controlling air-to-fuel ratio in starting an engine in cooperation with a carburetor for supplying the amount of fuel into an engine according to the amount of intake air, which comprises the following steps of:

(a) detecting engine speed N;

(b) detecting intake air pressure $P_A$;

(c) detecting engine coolant temperature $T_C$;

(d) detecting intake air temperature $T_A$;

(e) comparing the detected intake air temperature $T_A$ with a reference value $T_{AO}$;

(f) if the detected intake air temperature $T_A$ is lower than the reference value $T_{AO}$, selecting a lower air temperature table $D_1$ with the detected engine speed N and intake air pressure $P_A$ as parameters and selecting a duty factor corresponding to the detected coolant temperature $T_C$ from the lower air temperature table $D_1$;

(g) if the detected intake air temperature $T_A$ is equal to or higher than the reference value $T_{AO}$, selecting a higher air temperature table $D_2$ with the detected engine speed N and intake air pressure $P_A$ as parameters and selecting a duty factor corresponding to the detected coolant temperature $T_C$ from the higher air temperature table $D_2$;

(h) generating a control signal having the selected duty factor; and (i) activating an actuator associated with the carburetor in response to a control signal to increase the amount of fuel to be supplied to the engine through the carburetor.

7. The method of controlling air-to-fuel ratio in starting an engine as set forth in claim 6, wherein in the lower air temperature table $D_1$, the duty factor is fixedly determined to a lower percent when engine coolant temperature $T_C$ is higher than 50° C. and to a higher percent when engine coolant temperature $T_C$ is lower than 20° C., but increased linearly from lower percent to higher percent when engine coolant temperature changes from 50° C. to 20° C. and wherein in the higher air temperature table $D_2$, the duty factor is fixedly determined to a lower percent when engine coolant temperature $T_C$ is higher than 20° C. and to a middle percent when engine coolant temperature $T_C$ is lower than 10° C., and increased linearly from the lower percent to the middle percent when engine coolant temperature changes from 20° C. to 10° C., these lower and higher air temperature tables $D_1$ and $D_2$ being selected with the detected engine speed N and intake air pressure $P_A$ as parameters.

* * * * *